United States Patent [19]

Uhlig

[11] 4,257,537

[45] Mar. 24, 1981

[54] CHILD RESISTANT SIFTER TYPE CLOSURE

[75] Inventor: Albert R. Uhlig, Toledo, Ohio

[73] Assignee: Owens-Illinois, Inc., Toledo, Ohio

[21] Appl. No.: 67,965

[22] Filed: Aug. 20, 1979

Related U.S. Application Data

[63] Continuation-in-part of Ser. No. 44,871, Jun. 1, 1979.

[51] Int. Cl.[3] ..... B67B 5/00

[52] U.S. Cl. ..... 222/153; 220/345; 220/346; 220/339; 220/281; 220/375; 220/306; 215/225; 215/306; 222/485; 222/561

[58] Field of Search ..... 222/153, 457.3, 480, 222/481, 482, 484, 485, 559, 561; 220/345, 346, 339, 281, 306, 375; 215/301, 225, 216, 306

[56] References Cited

U.S. PATENT DOCUMENTS

| | | | |
|---|---|---|---|
| 2,620,098 | 12/1952 | Kinley | 222/559 |
| 2,971,680 | 2/1961 | Wilson et al. | 222/484 |
| 3,160,325 | 12/1964 | Stull | 222/153 |
| 4,209,100 | 1/1980 | Uhlig | 222/153 |

*Primary Examiner*—H. Grant Skaggs
*Attorney, Agent, or Firm*—John R. Nelson; Myron E. Click; David H. Wilson

[57] ABSTRACT

An improved child resistant sifter fitment and closure for containers of harmful products includes an inverted cup-shaped body member formed of resilient plastic material and an integrally molded locking flap connected by an integral hinge to the periphery of the panel portion of the body member. The locking flap folds into a conforming recess in the top surface of the panel, and, in its folded position, all edges of the locking flap are flush with the adjacent top surfaces of the panel. Cooperating locking surfaces are provided on the flap and the body portion to retain the locking flap in its folded position, and to permit limited longitudinal movement of the locking flap relative to the panel. Dispensing openings are provided in the panel underlying the locking flap and an equal number of apertures are provided in the locking flap which are alignable with the dispensing openings by a longitudinal movement of the locking flap relative to the panel. Such longitudinal movement is produced by providing an upwardly opening recess in the portion of the side wall of the closure which underlies the hinged end of the locking flap, thus permitting the side wall portion to be moved inwardly by a compression action of the fingers to shift the locking flap longitudinally relative to the panel and align the dispensing openings.

9 Claims, 11 Drawing Figures

CHILD RESISTANT SIFTER TYPE CLOSURE

RELATED APPLICATIONS

This application constitutes a continuation-in-part of my copending application Ser. No. 044,871 filed June 1, 1979.

BACKGROUND OF THE INVENTION

This invention relates to a sifter fitment and closure for necked containers, and more particularly, to a child resistant sifter fitment and closure which is operable to an open position solely through the application of a compressive force to a particular portion of the side wall of the fitment.

There has been a large number of disclosures in the prior art of so-called child resistant or safety closures for necked containers which have incorporated a closure body portion and an integrally molded, hinged locking flap portion co-operating with the body portion to effect the closing of one or more dispensing openings in the panel of the body portion. Typical of such prior art disclosures are U.S. Pat. Nos. 3,845,872 to Townes; 3,927,805 to Stull; and 4,022,352 to Pehr. The safety feature embodied in each of these prior art safety closure constructions is the necessity for the application by the fingers of a significant downward force to a specific location on the top wall of the closure. In all cases, however, the closure is opened by an upward pivoting movement of the integral locking flap, thus exposing one or more dispensing openings in the top panel portion of the closure. When the dispensing openings are in the form of a plurality of small openings, such as are normally found in a sifter fitment, the closure is awkward to use because the integral locking flap is normally hanging in a position directly in the path of the granular products shaken through the dispensing openings in the closure panel. Moreover, it has been recognized that the actuation of this type of safety closure by a vertically applied force may inadvertently occur through a child banging the container with the closure attached against a hard surface in such manner that a downward opening force of the proper magnitude is applied to the proper spot of the safety closure. The possibility of such inadvertent opening of the closure by children significantly limits the usefullness of such prior art safety closure constructions.

In my co-pending application, Ser. No. 044,871, filed June 1, 1979, which is assigned to the assignee of this application, there is disclosed and claimed a safety closure construction wherein a segment of the annular wall of the closure is depressible by a compression action of the fingers to effect the release of co-operating latching surfaces holding the pivoted locking flap in a closed position. This construction requires not only the application of a compression force by the fingers but the concurrent application of a lifting force on the free end of the locking flap to effect the opening of the closure. Nevertheless, when applied to a sifter fitment type of closure, the locking flap still remains in a dangling position relative to the dispensing openings, interfering with the dispensing of the granular container products.

SUMMARY OF THE INVENTION

In accordance with this invention, a sifter fitment type safety closure is provided having a molded plastic inverted cup-shaped body portion connected by an integral hinge to a foldable locking flap, the locking flap being foldable into an appropriate recess provided in the top or panel of the body portion so that the edges of the locking flap are flush with the adjacent panel surfaces and inaccessible for actuation of the flap by the fingernail. Locking surfaces on the flap co-operate with locking surfaces on the panel portion of the closure to retain the flap in its folded position, but permit linear movement of the flap relative to the panel in a direction parallel to its longitudinal axis. Such longitudinal movement of the flap may be produced by providing a recess in the side wall of the closure beneath the hinged end of the locking flap so that the application of a compressive force to that portion of the side wall lying outside the recess will effect an inward deflection of that portion of the side wall and hence longitudinal movement of the locking flap. One or more dispensing openings are provided in the locking flap. The locking flap openings are, however, alignable with the dispensing openings in the panel only when the locking flap is longitudinally shifted by depression of the mentioned portion of the side wall. The release of the compression force on the side wall portion of the closure will immediately effect the return of the locking flap to its original longitudinal position wherein the openings in the locking flap are misaligned with the dispensing openings in the panel, and hence the sifter closure is effectively sealed.

In accordance with a modification of the invention, a locking surface is provided in the panel portion of the closure in a position to engage the free end of the locking flap as it moves to its dispensing position and hold the flap in its longitudinally shifted open position.

In a further modification of this invention an additional set of co-operating locking surfaces are provided on the locking flap and the panel to lock the flap against opening movement until a downward force is applied to a specific portion of the flap.

Other advantages of the invention will become apparent to those skilled in the art from the following detailed description, taken in conjunction with the annexed sheets of drawings on which are shown a number of modifications of this invention.

DESCRIPTION OF PREFERRED EMBODIMENTS

Figure 1:
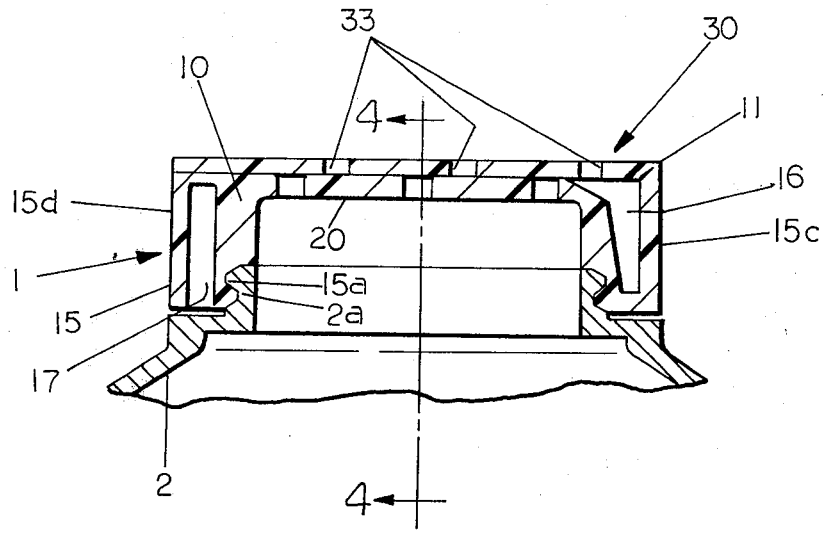
FIG. 1 is a vertical sectional view of a sifter type closure embodying this invention shown in assembled relationship to a neck container.
Figure 3:
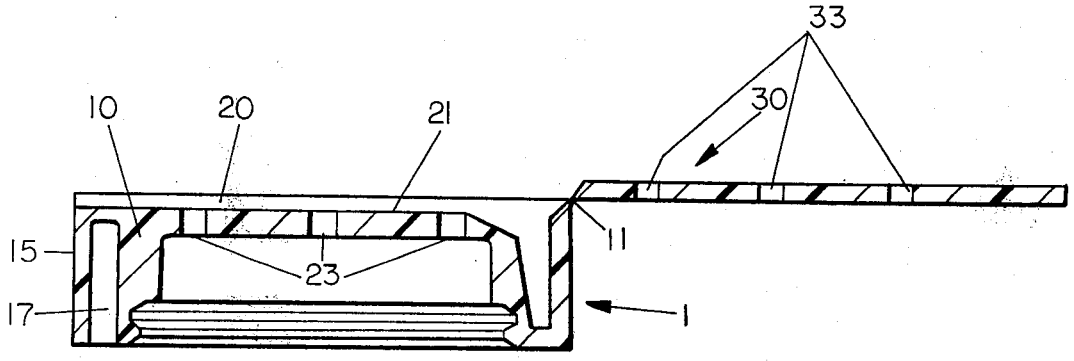
FIG. 3 is a multi-plane sectional view taken on the plane 3—3 of FIG. 2.

Referring to the drawings, the numeral 1 indicates generally a sifter closure embodying this invention. Closure 1 is molded from a resilient plastic material and comprises an inverted cupshaped body portion 10 having a panel portion 20 and an integral annular depending wall 15. A locking flap 30 is integrally molded with body portion 10, being connected thereto by an integral hinge 11 located at a peripheral portion of the panel 20. The top surface of panel 20 is provided with a recess 21 which is proportioned to snugly receive the flap 30 therein when such flap is folded to the closed position of the closure indicated in FIG. 1. In the modification of FIGS. 1 through 5, recess 21 extends completely across panel 20, thereby permitting the locking flap 30 to move longitudinally relative to the panel recess 21.

The annular wall 15 of the sifter closure 1 is provided with appropriate threads or a groove 15*a* on its internal surface for detachably mounting the sifter closure 1 to the similarly shaped neck 2*a* of a container 2. The engagement of groove 15*a* with container neck 2*a* is sufficiently snug as to eliminate any leakage of granular material from the interior of the container.

Figure 2:
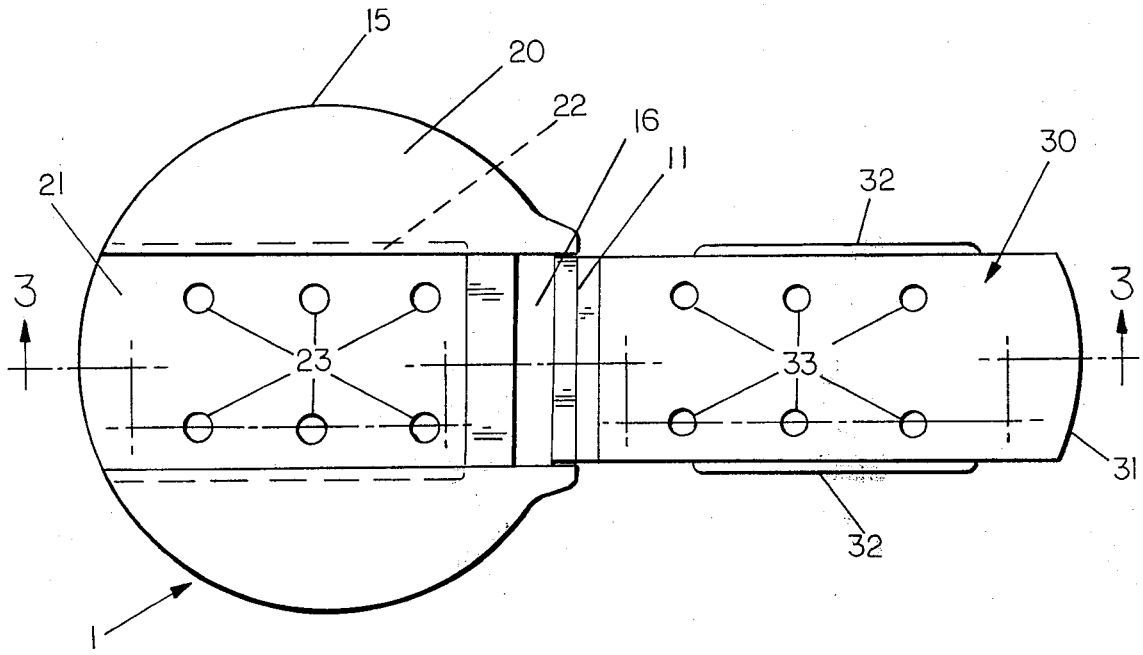
FIG. 2 is a top elevational view of the sifter type fitment employed in FIG. 1 in its as-molded configuration.
Figure 4:
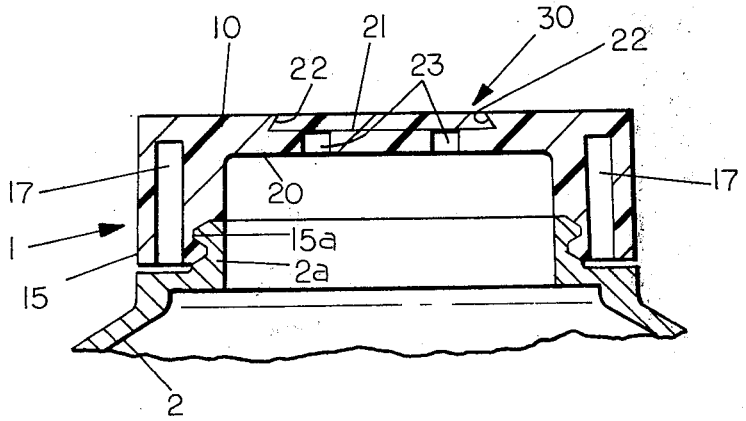
FIG. 4 is a sectional view of the closure taken on the plane 4—4 of FIG. 1.
Figure 5:
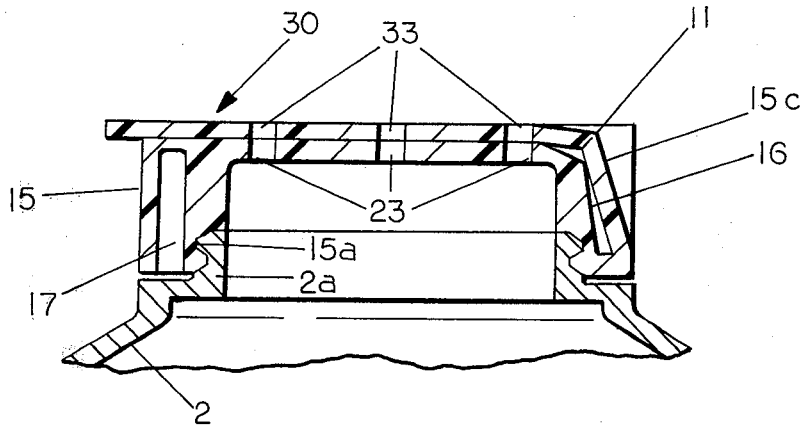
FIG. 5 is view similar to FIG. 1 but showing the longitudinal displacement of the locking flap of the sift closure to its open position.

Co-operating locking surfaces are provided in the panel 20 and on the locking flap 30 to retain the locking flap 30 in its folded position relative to panel 20, but permit linear movement of the locking flap 30 relative to the panel 20. As best shown in FIGS. 2 and 4, such locking surfaces comprise a dove-tailed wall 22 formed on each side of the recess 21 which co-operate with a correspondingly shaped tongue-like projection 32 provided on each lateral side of the locking flap 30.

That portion of the annular wall 15 which immediately underlies the hinged end of the locking flap 30 is relatively thick in its radial dimension so as to permit an upwardly opening recess 16 to be formed therein. Such recess defines an outer wall segment 15*c* which is readily radially inwardly depressible through the application of a compressive force by the fingers to the side wall segment 15*c*. In order to avoid an unsightly bulge in the overall closure configuration, the remainder of the side wall 15 may also be radially enlarged to provide a uniform circular outer wall 15*d* but all portions of the outer wall 15*d* except those immediately adjacent the upwardly opening recess 16 are provided with a downwardly opening recess 17 in order to minimize the amount of plastic material incorporated in the closure 1.

Radially inward movement of the depressible wall segment 15*c* results in a longitudinal linear shifting of the closure flap 30 relative to the panel 20. Panel 20 is provided with a plurality of dispensing openings 23 which are appropriately sized in relationship to the size of the granular product to be contained within container 2 to permit dispensing thereof. Locking flap 30 is provided with a similar number of apertures 33 which, in the normal position of the locking flap 30 shown in FIG. 1, are misaligned with the dispensing openings 23, but in the longitudinally shifted position of the locking flap 30 shown in FIG. 5, the apertures 33 are respectively aligned with the dispensing openings 23 and the granular contents of the container 2 may be then readily dispensed through the sifter openings.

It will be noted that such dispensing action can only occur so long as a compressive force is maintained on the portion 15*c* of the wall 15 of the closure 1. The release of such force immediately permits the wall segment 15*c* to snap back to its normal locked position shown in FIG. 1, pulling with it the locking flap 30. Thus, for a child to dispense the contents of container 2, he must have sufficient mental and physical ability to maintain a compressive force at the right position on the wall 15 of the closure 1 while shaking the container in an inverted position. It is readily apparent that the possibilities of this occurring are quite remote.

Figure 6:
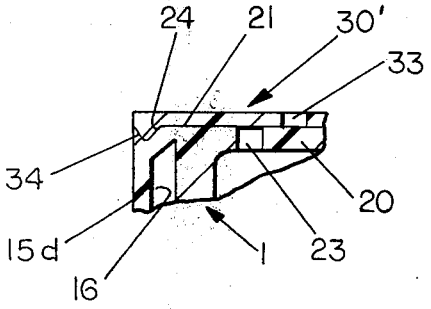
FIG. 6 is a partial sectional view of a modified closure embodying this invention incorporating means for locking the slidable locking flap in its open position. The flap is shown in its closed position.
Figure 7:
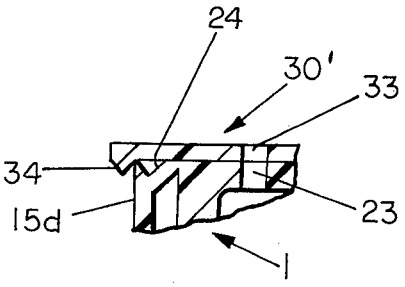
FIG. 7 is a view similar to FIG. 6 but showing the locking flap in its open position.
Figure 8:
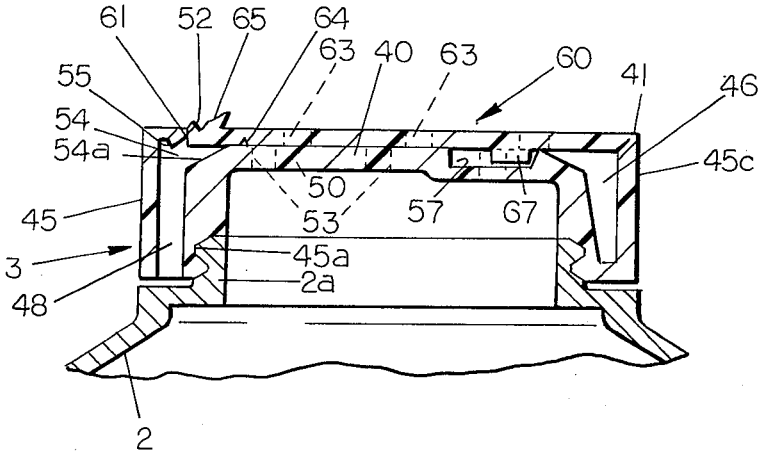
FIG. 8 is a vertical sectional view of a modified sifter closure embodying this invention showing the longitudinally shiftable locking flap in its closed position.
Figure 10:
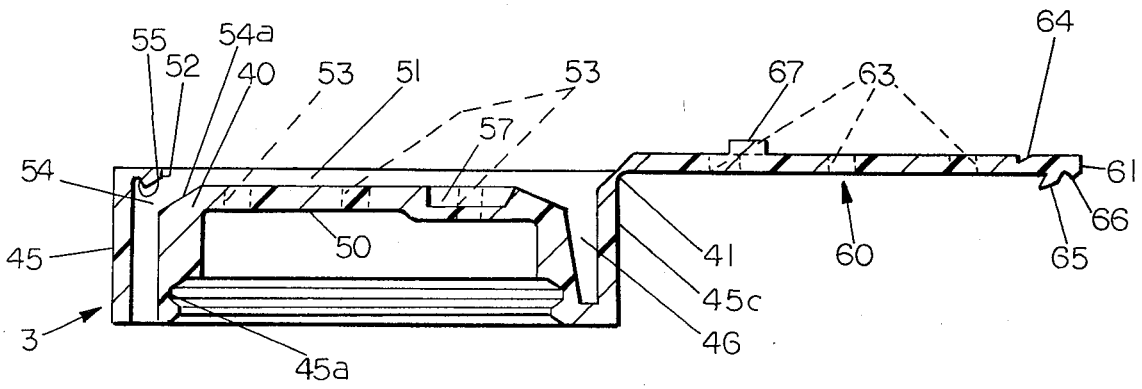
FIG. 10 is a vertical sectional view taken on the plane 10—10 of FIG. 9.
Figure 9:
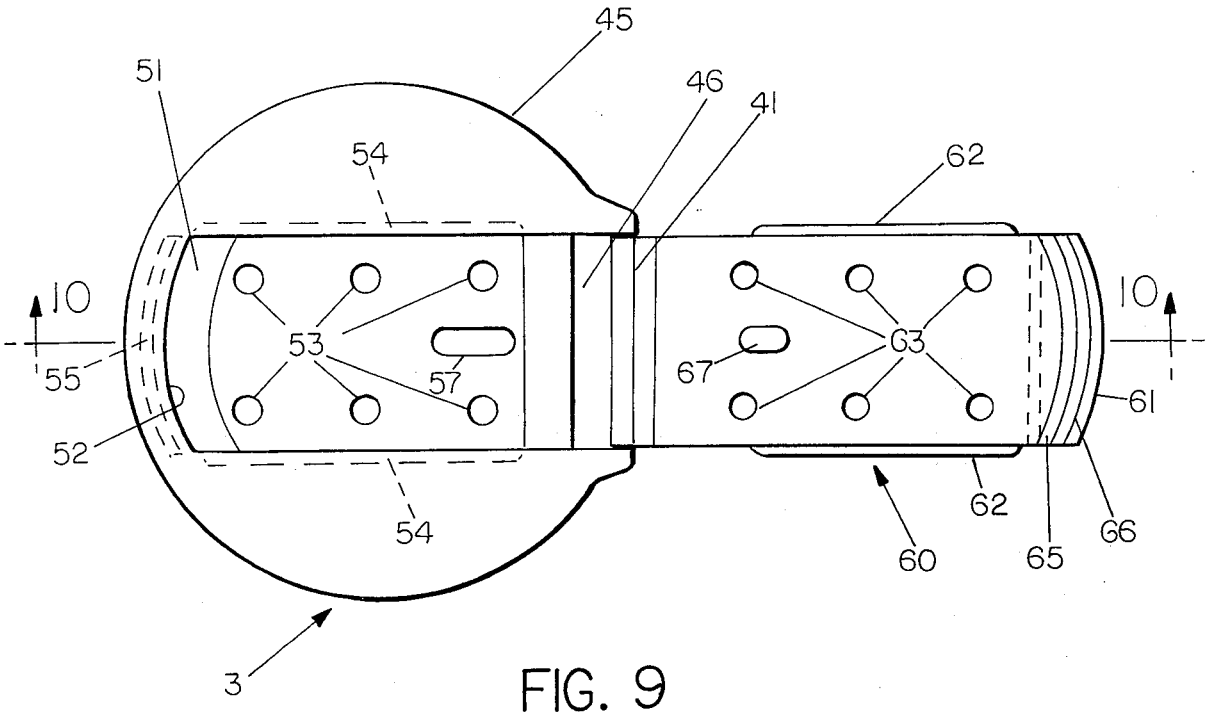
FIG. 9 is a top elevational view of the sifter closure employed in FIG. 8, shown in its as-molded configuration.

The construction of this invention finds utility in sifter type closures which are not primarily designed as child resistant or safety closures. It may, for example, be desirable to resiliently lock the sifter closure in its unlocked position. This may be accomplished with the configuration illustrated in FIGS. 6 and 7 of the drawings, wherein similar numerals indicate similar components to those already described. Thus the locking flap 30 is provided adjacent its free end with a depending triangular locking rib 34 which co-operates with a triangular locking recess 24 formed in the top surface of the panel recess 21. The co-operation of rib 34 with notch 24 not only provides a yieldable obstruction to maintain the locking flap 30 in its closed position illustrated in FIG. 6, but, when the depressible wall segment 15*c* is compressed by the fingers, the depending rib 34 will ride out of the notch 24 and engage the outer wall 15*d* of the closure 1, thereby resiliently locking the flap 30' in its open position wherein the flap apertures 33 are aligned with the dispensing apertures 23 as shown in FIG. 7.

A further modification of this invention is illustrated in FIGS. 8 through 11 wherein the difficulty of effecting the opening of the container has been measureably increased. In this modification, the sifter closure 3 comprises an inverted cup-shaped molded body portion 40 having a panel portion 50 and an integral annular depending wall 45. A locking flap 60 is integrally molded with body portion 40, being connected thereto by an integral hinge 41 located at a peripheral portion of the panel 50. The top surface of panel 50 is provided with a recess 51 which is proportioned to snugly receive the flap 60 therein when such flap is folded to the closed position of the closure illustrated in FIG. 8. In such closed position of the locking flap 60, the end face 61 of the locking flap is in snug engagement with an end wall 52 of the panel recess 51. As in the previous modifications, the locking flap 50 is secured for longitudinal movement within the panel recess 51 through the co-operation of lateral projections 62 (FIG. 10) on the locking flap 60 with undercut grooves 54 formed in the side walls of the panel recess 51.

That portion 45*c* of the side wall 45 that underlies the hinged end of the locking flap 60 is made radially depressible through the provision of an open top recess 46 in side wall 45. The side wall 45 is snugly engageable with a container neck 2*a* by virtue of the provisions of an annular groove 45*a* with a bead formed on the neck portion 2*a* of the container 2. Dispensing openings 53 are provided in the panel portion 50 and a corresponding number of apertures 63 are formed in the locking flap 60 and are alignable with the dispensing openings 53 only when locking flap 60 is moved longitudinally relative to the panel 50 by depressing the side wall segment portion 45*c*.

To permit longitudinal linear movement of locking flap 60, the end surface 61 of such flap must be removed from its abutting engagement with the panel recess end surface 52. To permit such movement, that portion of the panel recess 51 which underlies the free end portion of the locking flap 60 is provided with a recess 54 having an inclined bottom surface 54*a*. Locking flap 60 is provided with an undercut 64 immediately adjacent the intersection of the surface 54 with the under surface of the locking flap 60.

It will therefore be apparent that when a downward force is applied to the free end portion of the locking flap 60, such portion can move downwardly into the recess 54 and thus remove the end surface 61 of the locking flap 60 from its position of abutting engagement with the panel recess end surface 52. To facilitate such downward movement, locking flap 60 may be provided with an upstanding ridge 65 which may be more conviently engaged by a finger of the manipulator.

Figure 11:
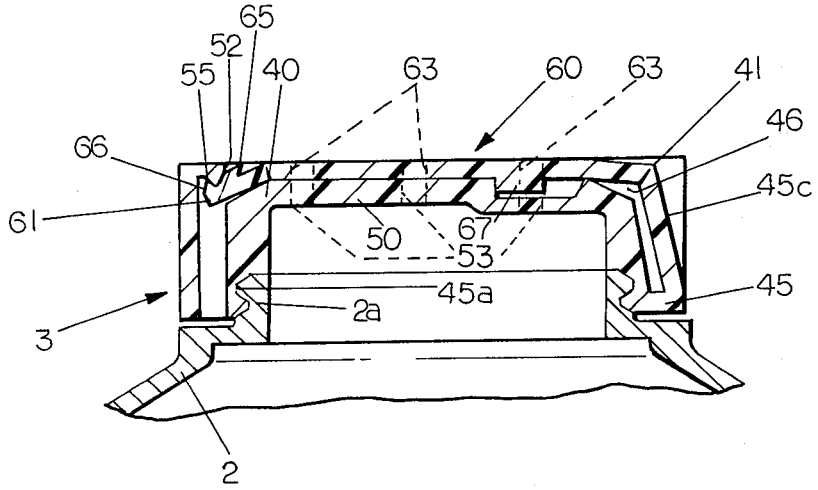
FIG. 11 is a view similar to FIG. 8 but showing the position of the longitudinally movable locking flap in its open dispensing position.

It necessarily follows that two distinct forces are required to effect a longitudinal shifting of the locking flap 60 to cause it to move to the open position shown in FIG. 11. The first such force is a downward force applied to the upstanding rib 65 which effects the removal of the end surface 61 of the locking flap 60 from its position of locked engagement with the recess end surface 52. The second force is the application of a compressive force to the wall segment 45*c* of the closure 40, which results in an inward depression of such wall segment and hence a longitudinal movement of the locking flap 60 to the position shown in FIG. 11 wherein the apertures 63 in the locking flap are in alignment with the dispensing openings 53 provided in the panel 50.

If it is desired to lock the flap 60 in its open, dispensing position, a locking recess 55 is formed immediately behind the end wall 52 of recess 51. Recess 55 then receives a correspondingly shaped hook portion 66 formed on the extreme end of the locking flap 60. Hook 66 is released from its engagement with the locking recess 55 by the application of a downward force to rib 65.

In all modifications it may also be desirable to provide means other than the inter-engagement of the locking surfaces to limit the longitudinal movement of the closure flap 60 relative to the panel portion 50 to avoid undue stresses. Such positive limitation may be provided through the co-operation of a depending lug 67 formed on the undersurface of locking flap 60 with a longitudinally extending slot 57 provided in the base of the recess 51. The end walls of slot 57 are so proportioned as to limit the movements of the locking flap 60 between the closed position shown in FIG. 8 and the open position shown in FIG. 11.

Further modification and applications of this invention will be readily apparent to those skilled in the art and it is intended that the scope of the invention be determined solely by the appended claims.

I claim:

1. A sifter fitment and closure for a container neck comprising an inverted cup-shaped body formed of resilient plastic material and having a generally circular top panel portion and an integral annular side wall, means on said side wall for detachably securing the fitment to a container neck, a locking flap connected to a peripheral portion of said panel by an integral hinge and being foldable into an overlying position relative to said panel, a set of co-operating locking surfaces on said locking flap and said panel for securing said locking flap in said overlying position, but permitting linear movement of said locking flap relative to said panel in the direction of its longitudinal axis, that portion of the annular side wall underlying said integral hinge being inwardly depressible whereby said wall portion may be inwardly depressed by compressing action exerted by the fingers to shift said locking flap longitudinally, and at least one dispensing opening formed in said panel beneath said locking flap and communicating with the interior of the container, said locking flap having an aperture therethrough which is aligned with said dispensing opening only when said locking flap is shifted longitudinally by depressing of said outer wall segment.

2. The sifter fitment of claim 1 plus means for resiliently locking said locking flap in a longitudinally shifted position.

3. The sifter fitment of claim 1 wherein said co-operating locking surfaces comprise laterally extending projections on said locking flap and undercut longitudinally extending grooves formed in the side walls of said recess and receiving said projections.

4. The sifter fitment of claim 1 plus a locking surface formed in the panel remote from said integral hinge, and a locking projection formed on the free end of said locking flap engageable with said locking surface only when said locking flap is longitudinally shifted to align the flap aperture with the dispensing opening, thereby locking the fitment in its open dispensing position.

5. A sifter fitment and closure for a container neck comprising an inverted cup-shaped body formed of resilient plastic material and having a generally circular top panel portion and an integral annular side wall, means on said side wall for detachably securing the fitment to a container neck, a locking flap connected to a peripheral portion of said panel by an integral hinge and being foldable into an overlying position relative to said panel, said panel having a recess in its top surface conforming to the configuration of said locking flap to receive said locking flap and said panel for securing said locking flap in said recess, but permitting linear movement of said locking flap relative to said panel in the direction of its longitudinal axis, that portion of the annular side wall underlying the hinged end of the locking flap having a top opening recess formed therein whereby the outer wall segment of said recess may be inwardly depressed by compressing action exerted by the fingers to shift said locking flap longitudinally, and at least one dispensing opening formed in the bottom surface of said recess and communicating with the interior of the container, said locking flap having an aperture therethrough which is aligned with said dispensing opening only when said locking flap is shifted longitudinally by depressing of said outer wall segment.

6. The sifter fitment defined in claim 5 wherein the bottom portion of said panel recess is provided with an elongated slot and said locking flap is provided with a depending protuberance insertable in said slot when said locking flap is inserted in said recess, said slot and said protuberance co-operating to limit the longitudinal movement of said locking flap relative to said recess produced by inward depression of said annular wall segment.

7. The sifter fitment of claim 5 plus a locking surface formed in the panel remote from said integral hinge, and a locking projection formed on the free end of said locking flap engageable with said locking surface only when said locking flap is longitudinally shifted to align the flap aperture with the dispensing opening, thereby locking the fitment in its open dispensing position.

8. The sifter fitment defined in claim 3 wherein the free end of said locking flap is in engagement with an end surface of said panel recess in the closed position of said locking flap, and the portion of said panel recess underlying the free end of said locking flap is recessed below the normal plane of the bottom surface of said locking flap to permit the free end of said locking flap to be depressed through the application of a vertical force to said free end to release the free end of the locking flap from its abutting engagement with the recess end surface.

9. The sifter fitment defined in claim 8 wherein the free end of said locking flap has an inclined surface formed on the top portion thereof and said end wall of said recess has a similarly inclined surface on the bottom portions thereof, whereby the depression of said free end of the locking flap followed by compression of said portion of the annular side wall produces a longitudinal movement of the locking flap to its open position and concurrently a downward movement of the free end of the locking flap into the said recess portion, and means for resiliently securing the free end of the locking flap in said depressed position.

* * * * *